US006806838B2

(12) United States Patent
Petros et al.

(10) Patent No.: US 6,806,838 B2
(45) Date of Patent: Oct. 19, 2004

(54) COMBINATION SATELLITE AND TERRESTRIAL ANTENNA

(75) Inventors: Argy Petros, Lake Worth, FL (US); Terry C. Helstrom, Boynton Beach, FL (US); Imtiaz Zafar, Sterling Heights, MI (US)

(73) Assignees: Delphi-D Antenna Systems, Troy, MI (US); XM Satellite Radio, Inc., Washington, DC (US)

( * ) Notice: Subject to any disclaimer, the term of this patent is extended or adjusted under 35 U.S.C. 154(b) by 0 days.

(21) Appl. No.: 10/218,176

(22) Filed: Aug. 14, 2002

(65) Prior Publication Data

US 2004/0032373 A1 Feb. 19, 2004

(51) Int. Cl.[7] ..... H01Q 21/00
(52) U.S. Cl. ..... 343/725; 343/713; 343/895
(58) Field of Search ..... 343/713, 702, 343/711, 725, 726, 727, 729, 895, 703

(56) References Cited

U.S. PATENT DOCUMENTS

| | | | | |
|---|---|---|---|---|
| 4,218,685 A | | 8/1980 | Ellis, Jr. | 343/727 |
| 4,442,438 A | | 4/1984 | Siwiak et al. | 343/792 |
| 4,466,003 A | | 8/1984 | Royce | 343/826 |
| 4,730,195 A | | 3/1988 | Phillips et al. | 343/792 |
| 5,161,255 A | | 11/1992 | Tsuchiya | 455/345 |
| 5,264,862 A | | 11/1993 | Kumpfbeck | 343/853 |
| 5,317,327 A | | 5/1994 | Piole | 343/725 |
| 5,440,317 A | | 8/1995 | Jalloul et al. | 343/791 |
| 5,600,341 A | | 2/1997 | Thill et al. | 343/895 |
| 5,923,305 A | | 7/1999 | Sadler et al. | 343/895 |
| 6,069,588 A | * | 5/2000 | O'Neill, Jr. | 343/713 |
| 6,100,847 A | * | 8/2000 | Sointula | 343/702 |
| 6,160,512 A | | 12/2000 | Desclos et al. | 343/700 |
| 6,281,852 B1 | * | 8/2001 | Amarillas | 343/725 |
| 6,295,033 B1 | | 9/2001 | Chatzipetros et al. | 343/713 |
| 6,320,549 B1 | | 11/2001 | Nybeck et al. | 343/727 |
| 6,329,954 B1 | | 12/2001 | Fuchs et al. | 343/725 |
| 6,538,609 B2 | * | 3/2003 | Nguyen et al. | 343/713 |
| 6,538,611 B2 | * | 3/2003 | Noro | 343/725 |

FOREIGN PATENT DOCUMENTS

| | | | |
|---|---|---|---|
| DE | 19933723 | 7/1999 | H01Q/21/28 |
| EP | 0957533 | 11/1999 | H01Q/5/00 |
| GB | 2339969 | 9/2000 | H01Q/5/00 |
| JP | 4134906 | 5/1992 | H01Q/5/00 |
| JP | 6334436 | 12/1994 | H01Q/21/26 |

* cited by examiner

*Primary Examiner*—Tho Phan
(74) *Attorney, Agent, or Firm*—Roylance, Abrams, Berdo & Goodman, L.L.P.

(57) ABSTRACT

A combined antenna system used for both vehicles and structures, whereby a satellite antenna is placed concentrically around a conventional mast antenna that can be used for both conventional FM radio and also terrestrial retransmission of the satellite broadcast signals. The combined antenna system, in a vehicle implementation, is configured to use only the one hole created in the vehicle manufacturing process, thereby preventing the necessity of drilling a second hole for the satellite antenna, which alleviates deterioration of the vehicle's body. Additionally, because the combined antenna system can be advantageously placed, a shorter RF cable connecting it to a receiver box can be implemented than otherwise would be the case for a satellite antenna located on a window or roof of a vehicle. In an alternative embodiment, the satellite antenna can be mounted on either a fixed or retractable terrestrial antenna, thereby raising the satellite antenna to a higher elevation with respect to any obstacles on the vehicle or structure.

44 Claims, 11 Drawing Sheets

COMBINATION SATELLITE AND TERRESTRIAL ANTENNA

CROSS REFERENCE TO RELATED APPLICATIONS

Related subject matter is disclosed in U.S. Pat. No. 6,295,033, issued Sep. 25, 2001; in co-pending U.S. non-provisional patent application Ser. No. 09/953,146, filed Oct. 19, 2000; in co-pending U.S. non-provisional patent application Ser. No. 09/982,112, filed Oct. 19, 2001; and in co-pending U.S. non-provisional application Ser. No. 09/844,699 filed Apr. 30, 2001, the entire content of each said patent and application being expressly incorporated herein by reference.

FIELD OF THE INVENTION

The invention relates generally to radio antennas. More particularly, the invention relates to terrestrial radio and satellite communication antennas for vehicles and other mobile or fixed structures. The invention also relates to an integral antenna assembly that comprises one or more antennas for mounting externally on the surface of a vehicle or other mobile or fixed structure.

BACKGROUND OF THE INVENTION

With reference to FIGS. 1 and 2, a number of antenna systems have been proposed which provide for the reception of satellite transmission signals on vehicles and other mobile or fixed structures. FIG. 1 illustrates a known antenna system that allows transfer of RF energy across a dielectric such as glass for reception of satellite transmitted signals. The antenna illustrated in FIG. 1 provides for the transfer of radio frequency (RF) energy through glass or other dielectric surface to avoid having to drill holes, for example, through the windshield or window of an automobile for installation. After-market glass-mount antenna systems are advantageous because they obviate the necessity of having to provide a proper seal around an installation hole or other window opening in order to protect the interior of the vehicle and its occupants from exposure to external weather conditions.

In the known antenna system 20 depicted in FIG. 1, RF signals from an antenna 22 are conducted across a glass surface 24 via a coupling device 26 that typically employs capacitive coupling, slot coupling or aperture coupling. The portion of the coupling device 26 on the interior of the vehicle is connected to a matching circuit 28 which provides the RF signals to a low noise amplifier (LNA) 32 at the input of a receiver 34 via an RF or coaxial cable 30.

FIG. 2 illustrates an alternative embodiment of the antenna system of FIG. 1, except that antenna 42 has been displaced to the roof of the vehicle, and is kept in place by a magnet or other securing means. Through cable 54 the RF signal travels to coupler 45, through the vehicle's glass (e.g., back windshield) and to second coupler 44. The RF signal then travels through RF cable 46A to LNA 47 and then through RF cable 46B to receiver 48.

Both types of antenna mounting systems—the window mount system and roof mount magnetic system of FIGS. 1 and 2 respectively—suffer from serious deficiencies. First, the antenna of either FIG. 1 or FIG. 2 is, in all likelihood, a second or even third antenna, and thus adds an unsightly appearance to the vehicle or structure. Regarding the window mount system of FIG. 1, RF coupling loss through glass is generally 1 dB or higher. This causes an increase in noise figure that results in degradation of receiver sensitivity.

Regarding the body mount system of FIG. 2, there are also serious deficiencies. For example, the installation of antenna 42 is located remotely with respect to LNA 47 and radio receiver 48 is generally considered unattractive to consumers of mobile satellite services. This is true for several reasons. First, an antenna mounted on the roof of a vehicle adds to the clearance height of the vehicle, which may be prove to be troublesome if parking in a garage. Often, users will forget that the antenna is on the roof, and will cause damage either to the antenna itself and/or the vehicle. Or, the user may have to stop the vehicle, exit it, and dismantle the antenna in order to proceed to park in the garage. This is, of course, a needless waste of time and energy.

Secondly, the roof mounted antenna is unsightly, not only to the external observer, but also to the occupants in installations where the RF cables must be routed through the interior of the vehicle. In the case of a window mounted antenna, the couplers may obstruct vision and generally make the appearance of the vehicle unsightly.

A need therefore exists for a vehicle antenna mounting system whereby both types of antenna (i.e., a vehicle's OEM supplied AM/FM antenna and an antenna for the reception of SDARS signals) can be co-located, so as to minimize, if not entirely prevent, any additional holes in a vehicle's exterior shell or eliminate the need to locate a magnetically mounted antenna on the glass of an auto, or to use antenna couplers in the glass portion of an auto, yet provide an integral assembly for installation on the exterior of a vehicle, and an effective means for reception of both terrestrial AM/FM signals and satellite transmitted signals.

SUMMARY OF THE INVENTION

The above described disadvantages are overcome and a number of advantages are realized by the present invention which relates to a combined satellite and terrestrial antenna system for a structure. The combined satellite and antenna system comprises a terrestrial antenna mounted on a mounting assembly, and a satellite antenna concentrically mounted with respect to the terrestrial antenna, with the mounting assembly comprising a low noise amplifier circuit and a bezel, the bezel adapted to contain the low noise amplifier.

The present invention further relates to a combined satellite and terrestrial antenna system for a vehicle, which comprises a terrestrial antenna mounted on a mounting assembly, and a satellite antenna concentrically mounted with respect to the terrestrial antenna, with the mounting assembly comprising a low noise amplifier circuit and a bezel. The bezel is adapted to contain the low noise amplifier, and the mounting assembly is mounted on the vehicle.

Additionally, the present invention relates to a method for mounting a combined satellite and terrestrial antenna system on a structure comprising the steps of mounting a terrestrial antenna on a mounting assembly; mounting the satellite antenna concentrically with the terrestrial antenna; mounting the mounting assembly in a mounting hole on a structure, wherein the mounting assembly comprises a low noise amplifier circuit and a bezel, with the bezel adapted to contain the low noise amplifier; locating satellite receiver hardware in proximity to the combined satellite and terrestrial antenna system; and connecting the satellite antenna, the terrestrial antenna, the satellite receiver hardware and terrestrial receiver hardware with appropriate cables.

BRIEF DESCRIPTION OF THE DRAWINGS

The novel features and advantages of the present invention will best be understood by reference to the detailed description of the specific embodiments which follows, when read in conjunction with the accompanying drawings, in which.

DETAILED DESCRIPTION OF THE PREFERRED EMBODIMENTS

Figure 1:
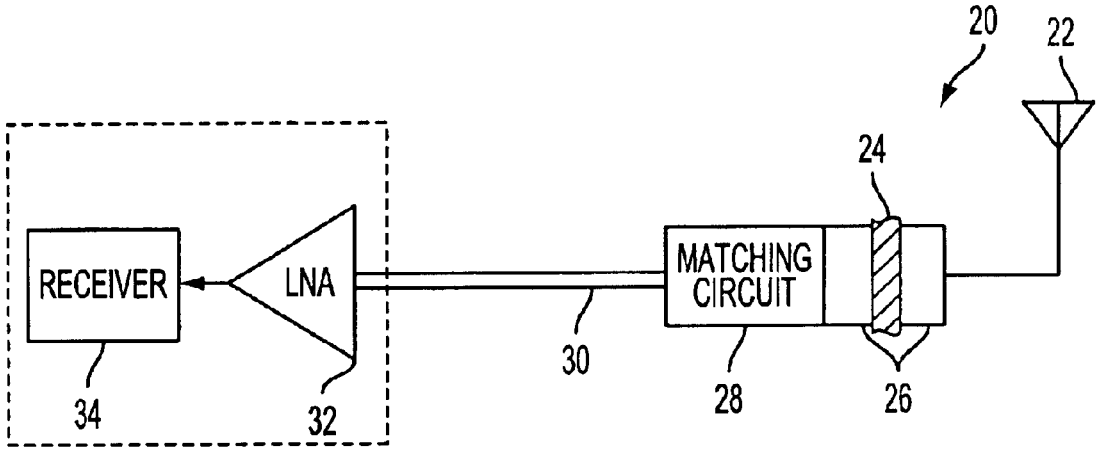
FIG. 1 (PRIOR ART)
FIG. 1 illustrates a known antenna system that allows inductive transfer of RF energy across a dielectric such as glass for reception of satellite transmitted signals.
Figure 2:
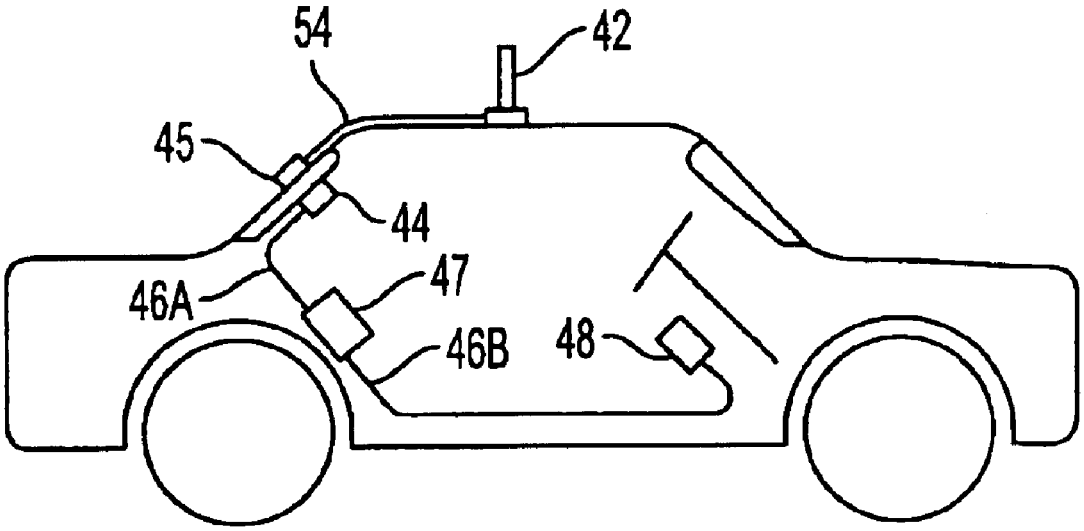
FIG. 2 (PRIOR ART)
FIG. 2 illustrates an alternative known embodiment of the antenna system of FIG. 1 mounted on a vehicle.

The various features of the preferred embodiment will now be described with reference to the drawings, in which like parts are identified with the same reference characters.

Figure 3:
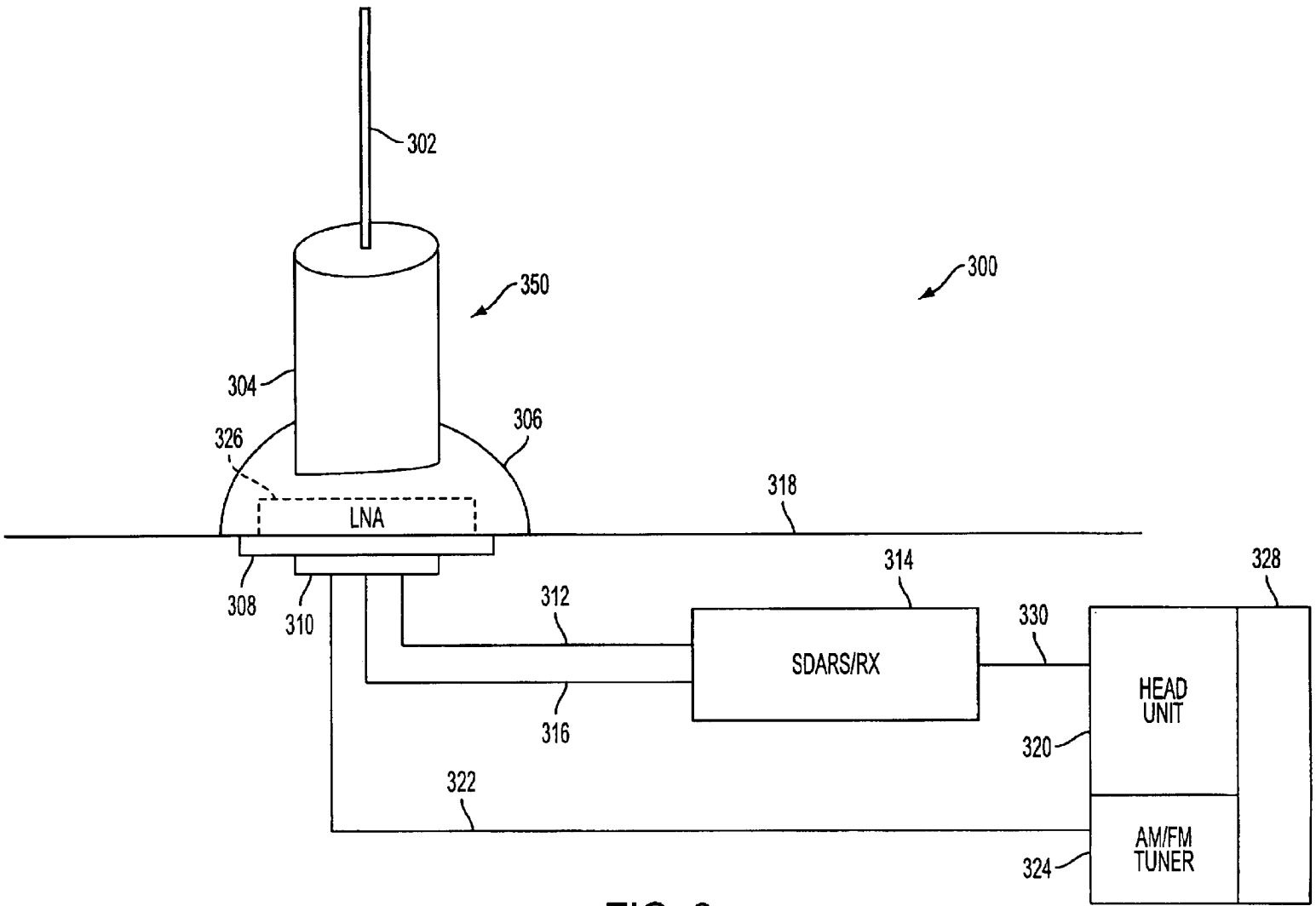
FIG. 3 illustrates a combined multi-band terrestrial and satellite antenna system installed on a vehicle for reception of AM, FM, satellite and terrestrial re-transmitted satellite signals according to an embodiment of the present invention.

FIG. 3 illustrates a combined multi-band terrestrial and satellite antenna system installed on a vehicle for reception of AM, FM, satellite and terrestrial re-transmitted satellite signals according to an embodiment of the present invention. The combined multi-band terrestrial/satellite antenna system 300 illustrated in FIG. 3 comprises a combined multi-band terrestrial/satellite antenna 350 which is, itself, comprised of multi-band terrestrial antenna 302, satellite antenna 304, bezel 306, nut 308, bolt 310, low noise amplifier (LNA) housing 326, SDARS satellite (SDARS/SAT) cable 312, SDARS terrestrial (SDARS/TER) cable 316 and AM/FM cable 322. The system further comprises SDARS receiver (SDARS/RX) 314, SDARS audio cable 330, and combined head unit and AM/FM tuner 328. Combined head unit and AM/FM tuner 328 is comprised of AM/FM tuner 324, and head unit 320. Multi-band terrestrial antenna 302 is used to receive conventional AM and FM transmitted signals and terrestrial retransmission of satellite transmitted signals. In other embodiments, it may receive and transmit cellular telephone signals, for example. Satellite antenna 304 may receive satellite transmitted signals directly. Combined multi-band terrestrial/satellite antenna 350 is shown mounted on surface 318, which might be the surface (or fender) of an automobile or other vehicle, or the surface of many other fixed or mobile structures.

As can be seen in FIG. 3, multi-band terrestrial antenna 302 has coaxially mounted around it satellite antenna 304. Both are secured through the mounting hole provided in surface 318, via nut 308 and bolt 310. The two antennas are mounted on bezel 306, which allows the antenna to always be vertical, even if surface 318 is somewhat slanted. Bezel 306 is mounted on surface 318. SDARS/SAT cable 312, SDARS/TER cable 316 and AM/FM cable 322 pass through bolt 310, which has a suitably large hollowed-out portion to pass the three cables through. In FIG. 8, a second embodiment of the invention is shown, and SDARS/TER cable 316 and AM/FM cable 322 are combined into AM/FM/SDARS/TER cable 718; this cable is also discussed in reference to FIG. 7. LNA housing 326 may, according to an embodiment of the invention, reside within bezel 306. Other configurations of LNA housing 326 are possible. Bezel 306, LNA housing 326 (and its components), nut 308 and bolt 310 comprise mounting assembly 350. LNA housing 326 will be discussed in detail in reference to FIGS. 7 and 8 below.

If surface 318 is the surface of an automobile, combined terrestrial/satellite antenna system 300 will have been located on a manufacturer-provided hole, i.e., one that the automobile manufacturer provided for the purpose of installing an AM/FM mast antenna. As such, no additional holes are needed, which eliminates the danger of corrupting the protective paint and/or rust-inhibiting materials applied by the manufacturer.

The two antennas, multi-band terrestrial antenna 302 and satellite antenna 304, can occupy only one space and utilize only one hole in a vehicle or structure's body, yet can provide access to at least two different services, as will be described in detail below. With regard to the discussion and the figures, the use of the combined multi-band terrestrial/satellite antenna 300 will be as if it were placed on an automobile; however, as will be discussed in detail below, combined multi-band terrestrial/satellite antenna 300 may be used with various vehicles and structures.

Multi-band terrestrial antenna 302 is used for AM and FM radio reception and for reception of terrestrial retransmission of the satellite transmitted signal. AM and FM radio is generally used for audio reception only, that is, for transmissions from local radio stations with various programming formats, including music, news, sports, "talk radio", and so on. These programming formats are familiar to many people and are the kind that are commonly received by users in their vehicles and mobile or fixed structures today. However, multi-band terrestrial antenna 302 may also be used for two-way cellular telephony and for reception of terrestrial retransmission of a satellite transmitted 'signal. The latter application will be discussed below.

The second antenna, satellite antenna 304, receives satellite transmission signals directly from one or more satellites placed in synchronous or non-synchronous earth orbits. Satellite transmissions may be used for audio programming, but can be used for other purposes as well.

As mentioned above, multi-band terrestrial antenna 302 is preferably used for AM and FM radio reception, and for reception of terrestrial retransmission of satellite transmitted signals. Radio frequency transmissions are often subject to multipath fading. This is especially true of satellite transmitted signals. Signal blockages at receivers can occur due to physical obstructions between a transmitter and the receiver or service outages. For example, mobile receivers encounter physical obstructions when they pass through tunnels or travel near buildings or trees that impede line of sight (LOS) signal reception. Service outages can occur when noise or multipath signal reflections are sufficiently high with respect to the desired signal. At these times, when a direct line-of-sight transmission path between the satellite and satellite antenna 304 is blocked, retransmission of the satellite signals from terrestrial retransmitters is very useful.

Figure 5A:
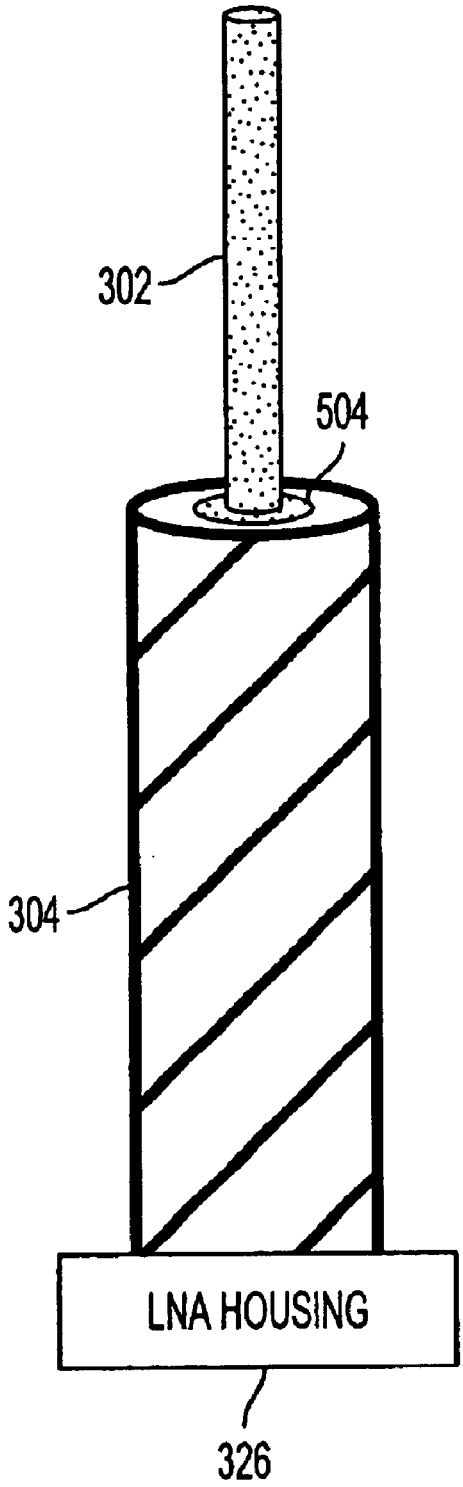
FIGS. 5A and 5B illustrate the mechanical configurations of a combined multi-band terrestrial/satellite antenna according to an embodiment of the present invention.
Figure 5B:
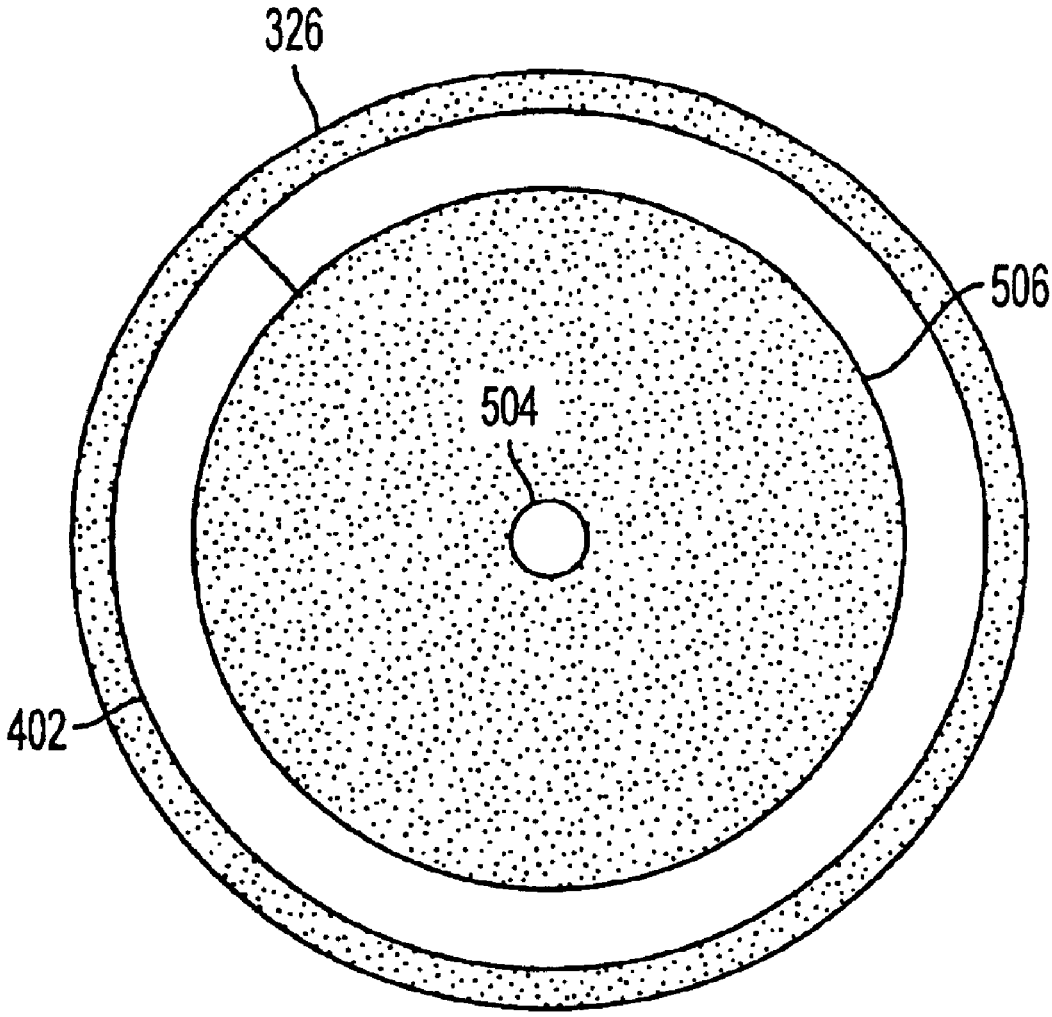

Referring again to FIG. 3, it can be seen that satellite antenna 304 is placed concentrically around multi-band terrestrial antenna 302 (this can also be seen in greater detail in FIGS. 5A and 5B). Satellite antenna 304 is preferably a quadrifilar helix antenna. A satellite antenna 304 that is comprised of a quadrifilar helix antenna has good performance in receiving satellite transmissions from geosynchronous orbit satellites. Since satellite antenna 304 is placed concentrically around multi-band terrestrial antenna 302, installation of satellite antenna 304 can be an after-market addition or by the original equipment manufacturer or OEM (automobile manufacturer). In both cases, the RF cables coming from both antennas will fit into the existing pre-cut hole that existing multi-band terrestrial antenna 302 has already been mounted on.

Mounting satellite antenna 304 around multi-band terrestrial antenna 302, which is itself mounted in an OEM-supplied hole, prevents the necessity of cutting an additional hole in a vehicle or structure thereby avoiding destroying the exterior finish and/or appearance of the vehicle or structure. It also eliminates the need to use a magnet (for a roof mounted system) or through-the-glass couplers (for window mounted systems). It is well known in the automotive industry that the application of paints and finishes provides a decorative and appealing uniform appearance, and prevents or inhibits the formation of rust in or on the body of the vehicle. By cutting a hole through this finish or paint, the intent of the manufacturer is circumvented in that a means for deterioration of the automotive body is provided. That is, it will be more likely than not that rust would form and water could enter and damage the interior of the vehicle. Additionally, drilling a hole in the surface of a fender of a vehicle adds the risk of chipping the paint and/or finish material, which may detract form the appearance of the vehicle. Also, placing a second antenna may be considered to be unattractive by many people.

Referring again to FIG. 3, combined multi-band terrestrial/satellite antenna 300 has three cables that lead from its base to other components of the system. The first cable is SDARS/SAT cable 312, which will be discussed in detail with reference to FIGS. 7 and 8. SDARS/SAT cable 312 carries the amplified received satellite signal. The second cable is SDARS/TER cable 316, which is also discussed in reference to FIGS. 7 and 8. SDARS/TER cable 316 carries the amplified terrestrial retransmission of a satellite (or cellular) signal. The third cable is AM/FM cable 322 which carries the AM/FM terrestrial signals received by multi-band antenna 302. However, because the two antennas are co-located, for example, on the trunk or rear fender of a vehicle, other components of combined multi-band terrestrial/satellite antenna system 300 may be located, for example, in the trunk of the vehicle, SDARS/SAT cable 312 and SDARS/TER cable 316 maybe shorter than otherwise would be the case (especially if satellite antenna 304 were roof or window mounted). A shorter length SDARS/SAT cable 312 and SDARS/TER cable 316 will significantly cut down on cable loss and thereby improve the capability (i.e., increase the signal-to-noise ratio and hence the sensitivity) of the radio. Another advantage is the cost savings due to a shorter cable.

Figure 4:
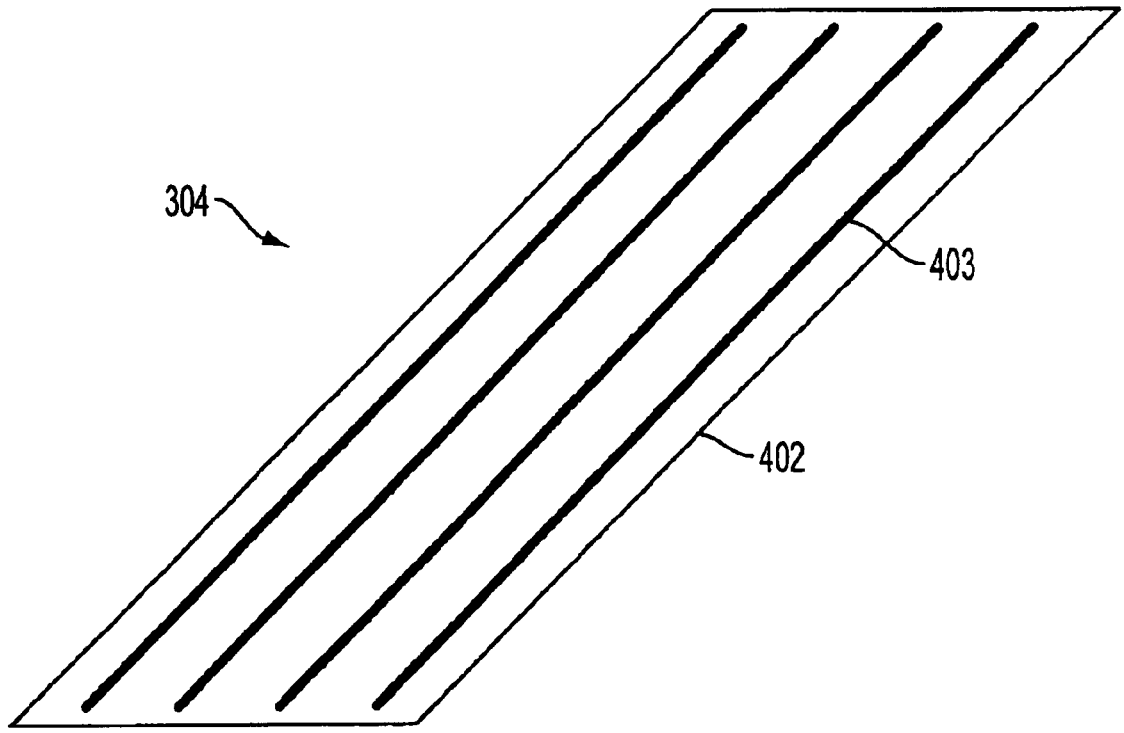
FIG. 4 illustrates a quadrifilar antenna etched on a flexible substrate that may be used in a combined multi-band terrestrial/satellite antenna according to an embodiment of the invention.

FIG. 4 illustrates a quadrifilar antenna etched on a flexible substrate that may be used in a combined multi-band terrestrial/satellite antenna according to an embodiment of the invention. Satellite antenna 304 is comprised of quadrifilar helix antenna, among other items, which will be discussed in detail in reference to FIGS. 5A and 5B. Conductive quadrifilar antenna elements 402 are etched on a flexible insulating substrate 403, according to a design which is well known to those skilled in the art. A weatherproofing material (not shown) may be applied to the exterior surface, in order to protect quadrifilar antenna 402 from the deteriorating effects of rain, sunshine, etc. Additionally, a binding agent (not shown) may be applied to the interior surface of quadrifilar antenna 304 when fabricated into the final form as shown in FIGS. 5A and 5B.

FIGS. 5A and 5B illustrate the mechanical configurations of a combined multi-band terrestrial/satellite antenna according to an embodiment of the present invention. FIG. 5A is an elevational view of combined multi-band terrestrial/satellite antenna 300. Satellite antenna 304 has within it a terrestrial antenna bore 504, to receive multi-band terrestrial antenna 302. LNA housing 326 is located at the base of combined multi-band terrestrial/satellite antenna 300. In one embodiment, LNA housing 326 is designed to be concealed within bezel 306. In different embodiments LNA housing might be located several feet away from combined multi-band terrestrial/satellite antenna 300. LNA housing 326 will be further discussed in reference to FIGS. 7 and 8.

FIG. 5B is a top view of combined multi-band terrestrial/satellite antenna 350. Here, it can be seen that terrestrial antenna bore 504 which is located at or near the center of satellite antenna 304, is large enough to slide over terrestrial antenna 302, and with the application of mounting glue or epoxy, will stay firmly in contact with the multi-band terrestrial antenna 302. Quadrifilar antenna 304 is placed around spacer 506, within which is formed terrestrial antenna bore 504.

Figure 6:
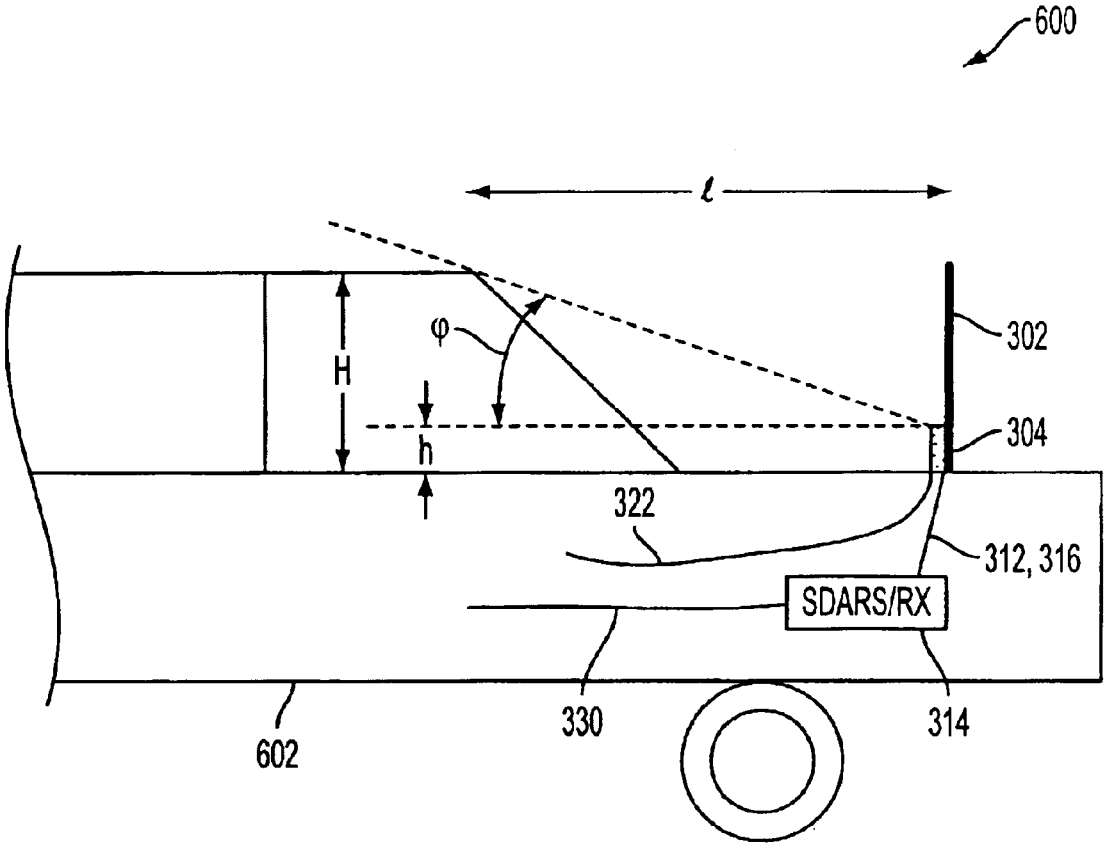
FIG. 6 illustrates the installation of a combined multi-band terrestrial/satellite antenna in a vehicle according to an embodiment of the invention.

FIG. 6 illustrates the installation of a combined multi-band terrestrial/satellite antenna on a vehicle according to an embodiment of the invention. FIG. 6 shows two heights, first height (h) which is the height of satellite antenna 304 and second height (H) which is the height of the roof of vehicle 602. Additionally, there is shown angle Φ. Angle Φ is the angle formed by a vertical line derived from first H and second h and a horizontal line comprised of length l. Length l is the distance between a vertical line established by combined multi-band terrestrial/satellite antenna 300 and apex of the roof closest to where combined multi-band terrestrial/satellite antenna 300 is located. Angle Φ should be less than 20°, in order to provide satisfactory reception from a geosynchronous orbit satellite at northerly latitudes. Angle Φ is equal to $\tan^{-1}((H+h)/(l))$.

Three factors affect angle Φ. The first is that for a given length l and second H, making first h greater would reduce angle Φ. Conversely, reducing first h would increase angle Φ (it is well known that most vehicles satisfy the condition Φ<20 degrees). The second factor is that for a given second H and first h, making length l longer, would reduce angle Φ. Conversely, reducing length l would increase angle Φ. And lastly, for a given length l and first h, making second H shorter, would reduce angle Φ. Conversely, increasing second H would increase angle Φ.

Therefore, it can be seen that in some circumstances angle Φ would be too great if configured as shown. In these circumstances a spacer may be placed under satellite antenna 304 to raise it up making first h greater thereby reducing angle Φ. These relationships are shown below:

$$\text{Angle}\Phi = \tan^{-1}\left(\frac{H-h}{l}\right)$$

$$\text{Tan}20 = 0.363$$

$$\therefore \frac{H-h}{l} \leq 0.363$$

Figure 7A:
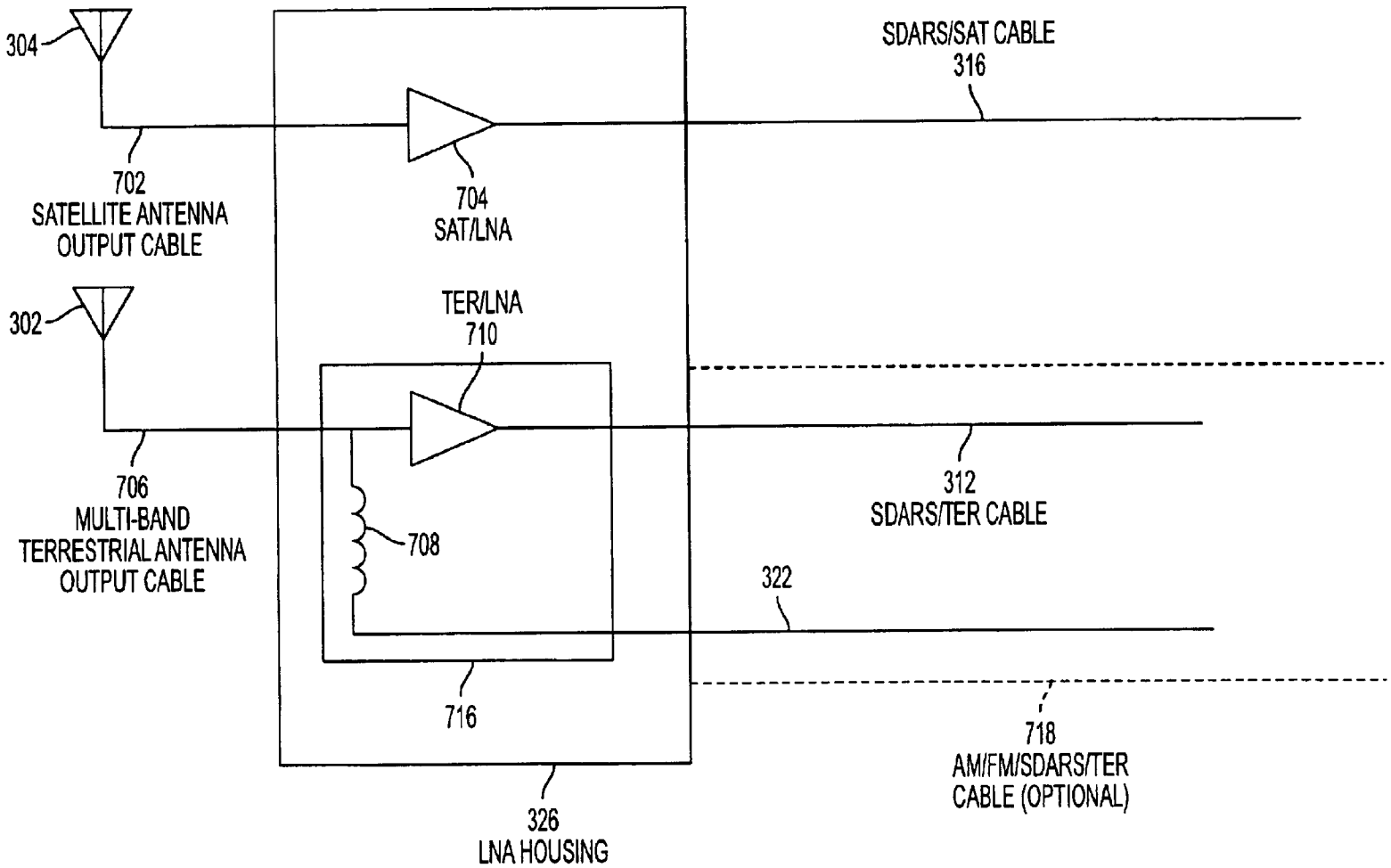
FIGS. 7A and 7B are schematic block diagrams of a multi-band terrestrial antenna, satellite antenna, low-noise amplifier and cabling at the point of installation according to alternative embodiments of the invention.
Figure 7B:
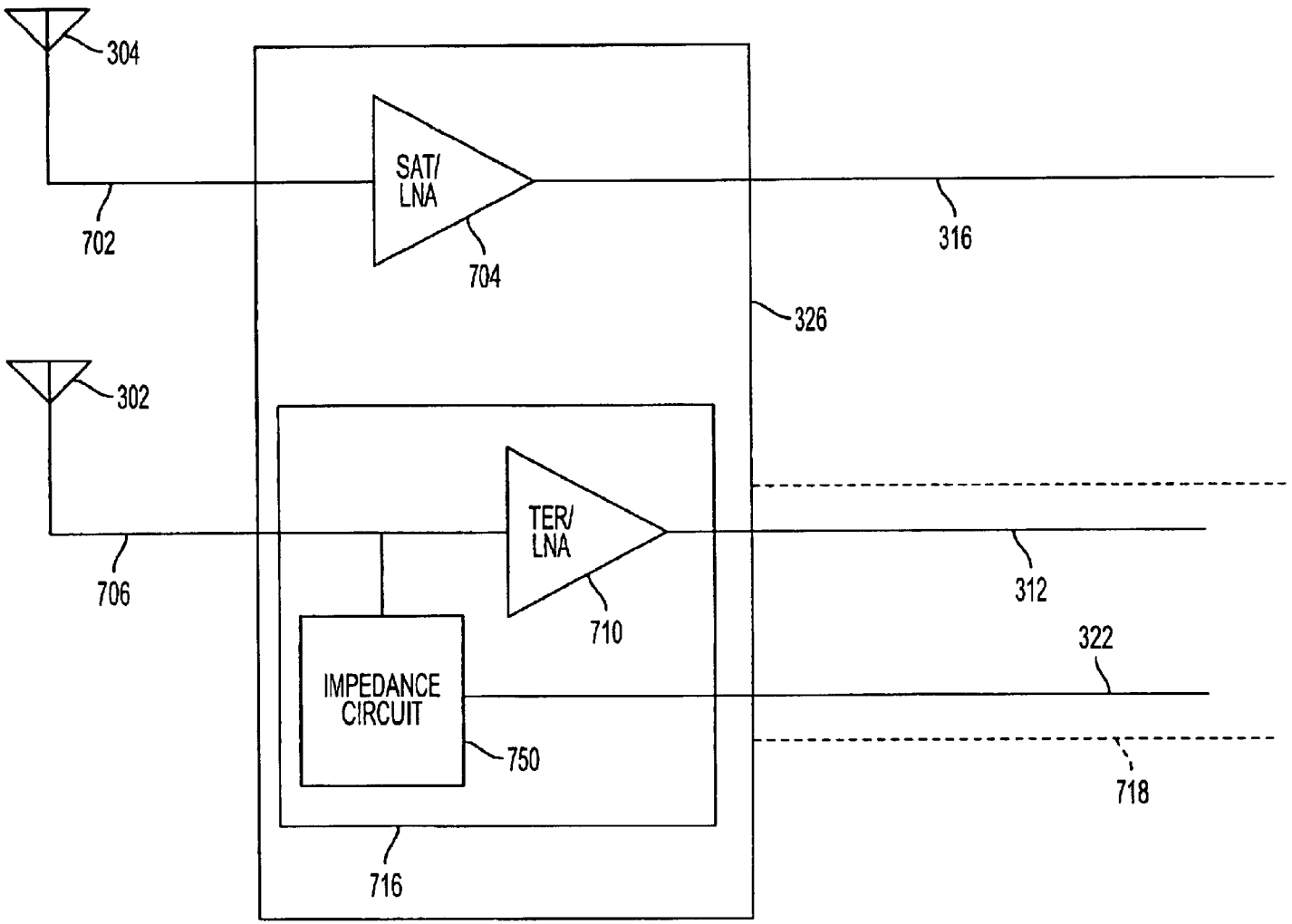
Figure 8:
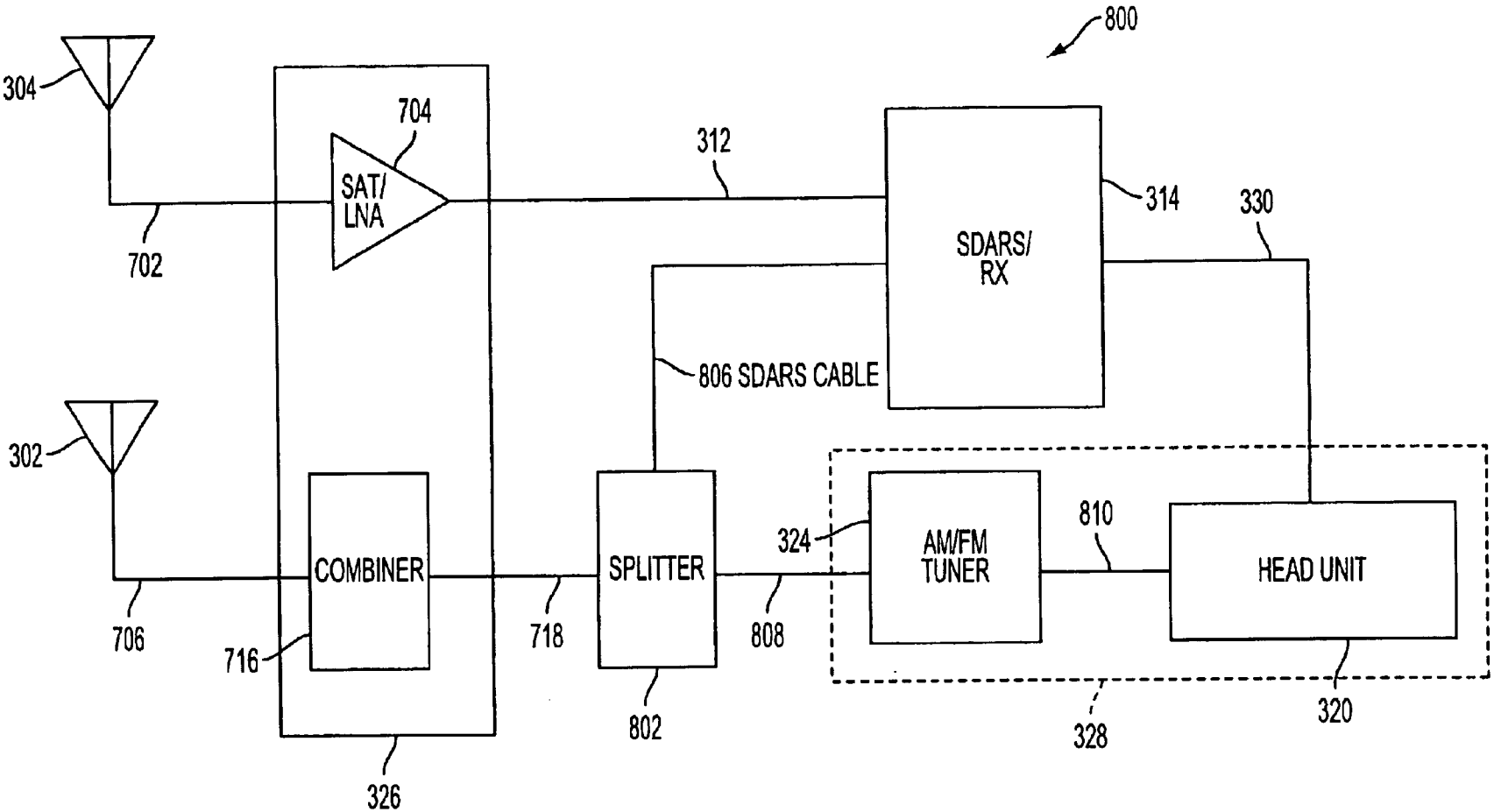
FIG. 8 is a schematic block diagram of a combined multi-band terrestrial and satellite antenna system for reception of AM, FM, satellite and terrestrial re-transmitted satellite signals according to another embodiment of the invention.

FIG. 7A is a schematic block diagram of a multi-band terrestrial antenna, satellite antenna, low-noise amplifier and cabling at the point of installation according to an embodiment of the invention. FIG. 7A shows the necessary electrical components to make combined multi-band terrestrial/satellite antenna 350 perform properly. Each antenna has a single RF cable originating from it. In the case of satellite antenna 304, it is satellite antenna output cable 702, and in the case of multi-band terrestrial antenna 302, it is multi-band terrestrial antenna output cable 706. Both of these cables are input to LNA housing 326.

In LNA housing 326, satellite antenna output cable 702 is connected directly to satellite low-noise amplifier (SAT/LNA) 704, and multi-band terrestrial antenna output cable 706 is connected to both terrestrial low noise amplifier (TER/LNA) 710 and inductor 708. Multi-band terrestrial antenna output cable 706 is connected to AM/FM cable 322 through inductor 708. The purpose of inductor 708 is to act as an open circuit (or high impedance) at the satellite terrestrial retransmission frequency, and as a short circuit (low impedance) at normal AM and FM radio transmission signal frequencies. This configuration does not cause any degradation on either antenna system (i.e., terrestrial antenna 302 or satellite antenna 304). Inductor 708 and TER/LNA 710 are contained in SDARS/AM/FM combiner 716, which is itself contained in LNA housing 502. Both satellite antenna output cable 702, and multi-band terrestrial antenna output cable 706 are very short, so the low noise figures of SAT/LNA 704 and TER/LNA 710 are maintained.

Inductor 708 may be replaced by a circuit 750 which can be configured to operate in the same manner as inductor 708. This can be seen in FIG. 7B which is identical to FIG. 7A except for the replacement of circuit 750 for inductor 708. That is, the circuit 750 could be comprised of a plurality of passive devices, active devices, or a combination of passive and active devices to act as an open circuit (or high impedance) at the satellite terrestrial retransmission frequency, and as a short circuit (low impedance) at normal AM and FM radio transmission signal frequencies. This configuration does not cause any degradation on either antenna system (i.e., terrestrial antenna 302 or satellite antenna 304). The circuit 750 and TER/LNA 710 would be contained in SDARS/AM/FM combiner 716 (as inductor 708 discussed above), which is itself contained in LNA housing 502. No design configurations of circuit 750 need be shown, because, as one skilled in the art would recognize, innumerable configurations are possible which would adequately perform the aforementioned functions of acting as a high impedance at certain frequencies and a low impedance at other frequencies.

The output of SAT/LNA 704 is connected to SDARS/SAT cable 312. Referring back to FIG. 3, SDARS/SAT cable 312 is connected directly to SDARS/RX 314, and carries the amplified signal received by satellite antenna 304. The output of TER/LNA 710 is connected to SDARS/TER cable 316. This cable carries the amplified signal received by multi-band terrestrial antenna 302. The signals received by multi-band terrestrial antenna 302 and then amplified by TER/LNA will encompass a broad range of signals, i.e., AM, FM, terrestrial re-transmissions of satellite signals, and perhaps even cellular signals, hence the term "multi-band". Suitable selection of TER/LNA 710 can have the effect of filtering undesirable signals (to a certain extent), or not, depending on specific design criteria.

In the first embodiment of the combined multi-band terrestrial/satellite antenna system, shown and discussed in reference to FIG. 3, three cables originated from combined multi-band terrestrial/satellite antenna 350. As discussed above, the three cables were connected to specific locations. As shown in FIG. 8, a second embodiment of the combined multi-band terrestrial/satellite antenna radio system 300 is possible, with the use of AM/FM/SDARS/TER cable 718. AM/FM/SDARS/TER cable 718 is a cable assembly which combines AM/FM cable 322 and SDARS/TER cable 316 into one assembly, for connection to a splitter, which will be discussed in detail below with reference to FIG. 8.

FIG. 8 is a schematic block diagram of a combined multi-band terrestrial and satellite antenna system for reception of AM, FM, satellite and terrestrial re-transmitted signals according to another embodiment of the invention. In most circumstances, SDARS/RX 314 and SDARS/AM/FM splitter 802 would be located in the trunk of a vehicle, or if the radio is in a mobile or fixed structure, they would be located close to combined multi-band terrestrial/satellite antenna 350. As discussed above, the output of SAT/LNA 704 is SDARS/SAT cable 312 and the output of TER/LNA 710 is SDARS/TER cable 316. SDARS/TER cable 316 may then be bundled with AM/FM cable 322 into AM/FM/SDARS/TER cable 718 and connected to SDARS/AM/FM splitter 802. Both of these cables may be up to 15 feet in length.

SDARS/RX 314 receives SDARS/SAT cable 312 and the first output of SDARS/AM/FM splitter 802, SDARS cable 806. The former is directly received satellite transmitted RF signals, and the latter is the terrestrial retransmission of the same satellite transmitted signals. The output of SDARS/AM/FM combiner 716 is AM/FM/SDARS/TER cable 718. AM/FM/SDARS/TER cable 718, which contains AM/FM cable 322 and SDARS/TER cable 316, is input to SDARS/AM/FM splitter 802. SDARS/AM/FM splitter 802 isolates the AM/FM and terrestrial re-transmitted satellite signals. The other output of SDARS/AM/FM splitter 802 is AM/FM/splitter cable 808, which is input to AM/FM tuner 324, the output of which is connected to head unit 320 via AM/FM tuner output cable 810. Head unit 320 also receives an output from SDARS/RX 314, which is the down-converted satellite transmission signal, which head unit 320 can then process and convert to an audio signal. The down-converted signal is carried by SDARS/Audio cable 330. Likewise, the output of AM/FM tuner 324 is a down-converted signal which head unit 320 can process and output as audio, to speakers (not shown). The signals contained in SDARS audio cable 330 and AM/FM tuner output cable 810 may be either analog or digital signals. If combined head unit AM/FM tuner 328 is located in a home, office or other large structure, it would be placed in a location convenient for the use of the occupant(s) of the structure.

Although discussion of the combined satellite/terrestrial antenna 350 and combined satellite/terrestrial antenna system 300 has focused on the particular application of an automobile, it should be readily apparent to one skilled in the art, that the combined satellite/terrestrial antenna system 300 can be just as easily used in an aircraft, boat, train, mobile home, recreational vehicle or truck. Each installation should ideally follow the same requirements as discussed with respect to FIG. 6, i.e., that angle Φ be less than 20°.

Care should be taking when installing combined terrestrial/satellite antenna 350 so that such installation does not defeat the minimum angle criterion.

Figure 9A:
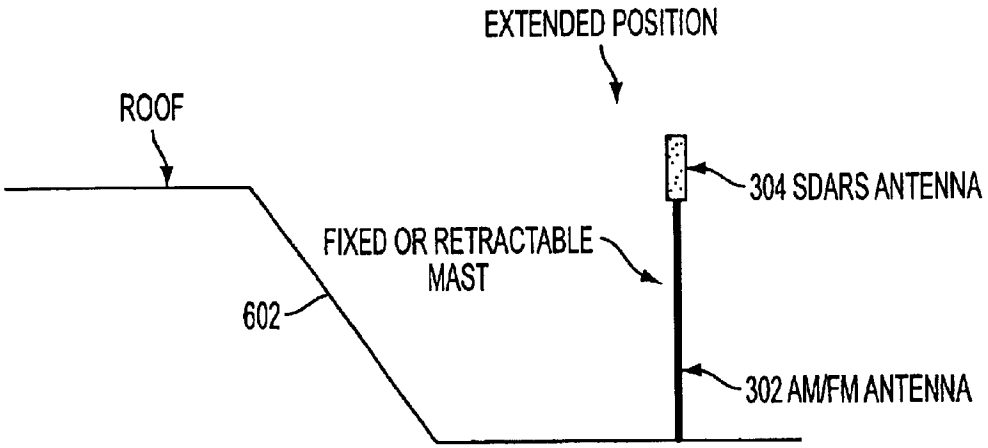
FIGS. 9A–9C illustrate an alternative embodiment of a combined multi-band terrestrial/satellite antenna according to the invention.
Figure 9B:
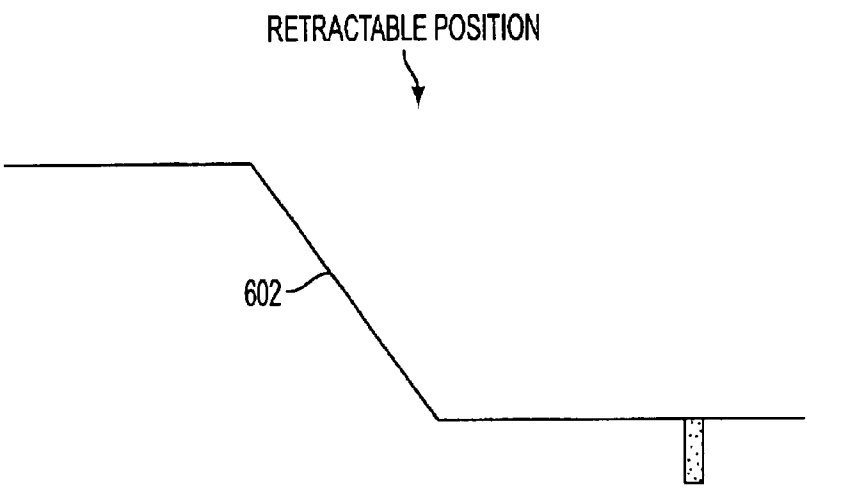
Figure 9C:
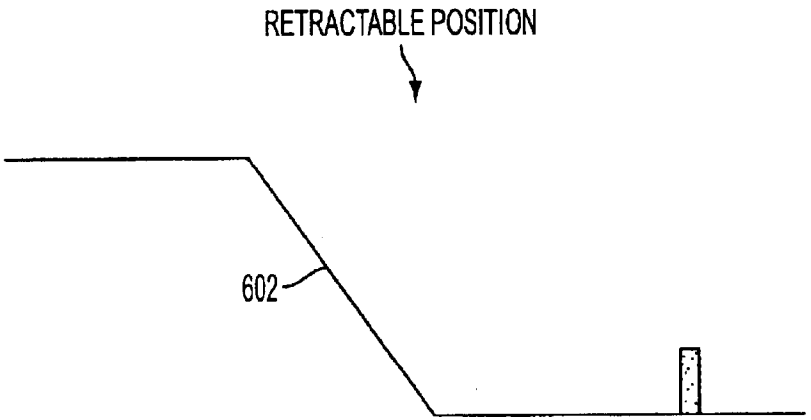

FIGS. 9A–9C illustrate an alternative embodiment of a combined multi-band terrestrial/satellite antenna according to the invention. In FIG. 9A satellite antenna 304 is configured to ride on the uppermost or highest portion of the terrestrial antenna 302. In this manner, the previously described restrictions on the angle between the roof of automobile 602 and the satellite antenna 304, for all practical purposes, disappears. In this alternative embodiment, the satellite antenna 304 is preferably located on the top, or highest vertical portion, of a fixed or retractable terrestrial antenna 302. If the terrestrial antenna 302 is fixed, then the embodiments of FIGS. 9B and 9C (described below) do not apply. That is, the combined satellite and terrestrial antenna structure would remain in the position illustrated in FIG. 9A. Of course, if the terrestrial antenna 302 is fixed, the satellite antenna 304 can be located at any point from the top to the bottom of the terrestrial antenna 302, and in most of those positions, the angular restriction discussed earlier would not be applicable.

Alternatively, the terrestrial antenna 302 may be a retractable antenna. In this case, it will descend into a suitable recessed area in the auto 602 such that it alone (as shown in FIG. 9C), or in combination with the satellite antenna 304 (as shown in FIG. 9B), resides completely within the recessed area. The advantage of the embodiments of FIGS. 9A–9C is that the angular restriction discussed above for the satellite antenna fixed in position at the base of the terrestrial antenna 302 is no longer an issue because the satellite antenna 304 rides either even with or above the roof of the auto 602. This improves reception capabilities of the satellite transmitted signals. Although the RF cabling connections to the satellite antenna 304 are not shown in FIGS. 9A–9C, one skilled in the art can understand and recognize that the RF cables can be contained within the core of the terrestrial antenna 302.

The present invention has been described with reference to certain exemplary embodiments thereof. However, it will be readily apparent to those skilled in the art that it is possible to embody the invention in specific forms other than those of the exemplary embodiments described above. This may be done without departing from the spirit of the invention. The exemplary embodiments are merely illustrative and should not be considered restrictive in any way. The scope of the invention is defined by the appended claims and their equivalents, rather than by the preceding description.

What is claimed is:

1. A combined satellite and terrestrial antenna system for a structure, comprising:

a multi-band terrestrial antenna mounted on a mounting assembly;

a satellite antenna having a different frequency band from that of the multi-band terrestrial antenna concentrically mounted with respect to the multi-band terrestrial antenna; and the mounting assembly comprising a low noise amplifier circuit and a bezel, the bezel containing the low noise amplifier.

2. The combined satellite and terrestrial antenna system for a structure, according to claim 1, wherein the satellite antenna comprises:

a quadrifilar helix antenna.

3. The combined satellite and terrestrial antenna system for a structure according to claim 2, wherein:

the quadrifilar helix antenna is configured to receive SDARS signals.

4. The combined satellite and terrestrial antenna system for a structure according to claim 1, further comprising:

both the multi-band terrestrial antenna and satellite antenna mounted at a common location on the structure, such that the angle formed by the difference in height between the top of an obstruction and the height of the satellite antenna, and the distance from the obstruction and the combined concentrically mounted satellite antenna and multi-band terrestrial antenna is less than 20 degrees.

5. The combined satellite and terrestrial antenna system for a structure according to claim 4, wherein the obstruction comprises:

a roof of an automobile.

6. The combined satellite and terrestrial antenna system for a structure according to claim 1, wherein the structure is selected from the group consisting of an automobile, a recreational vehicle, a house, a building, a train and an aircraft.

7. The combined satellite and terrestrial antenna system for a structure according to claim 1, wherein the multi-band terrestrial antenna comprises:

an multi-band antenna configured to receive conventional AM/FM transmitted signals and terrestrial re-transmissions of received satellite transmitted signals.

8. The combined satellite and terrestrial antenna for a structure according to claim 1, wherein:

the satellite antenna is mounted at any position on the multi-band terrestrial antenna.

9. A combined satellite and terrestrial antenna system for a vehicle comprising:

a multi-band terrestrial antenna mounted on a mounting assembly;

a satellite antenna having a different frequency band from that of the multi-band terrestrial antenna concentrically mounted with respect to the terrestrial antenna; and the mounting assembly comprising a low noise amplifier circuit and a bezel, the bezel containing the low noise amplifier, and wherein the mounting assembly is mounted on the vehicle.

10. The combined satellite and terrestrial antenna system for a vehicle, according to claim 9, wherein the satellite antenna comprises:

a quadrifilar helix antenna.

11. The combined satellite and terrestrial antenna system for a vehicle according to claim 10, wherein:

the quadrifilar helix antenna is configured to receive SDARS signals.

12. The combined satellite and terrestrial antenna system for a vehicle according to claim 9, further comprising:

both the multi-band terrestrial antenna and satellite antenna mounted at a common location on the vehicle, such that the angle formed by the difference in height between the top of an obstruction and the height of the satellite antenna, and the distance from the obstruction and the combined concentrically mounted satellite and multi-band terrestrial antenna is less than 20 degrees.

13. The combined satellite and terrestrial antenna system for a vehicle according to claim 12, wherein the obstruction comprises:

a roof of the automobile.

14. The combined satellite and terrestrial antenna system for a vehicle according to claim 9, wherein the vehicle is selected from the group consisting of an automobile, aircraft, train and a recreational vehicle.

15. The combined satellite and terrestrial antenna system for a vehicle according to claim 9, wherein the multi-band terrestrial antenna comprises:

a multi-band antenna configured to receive conventional AM/FM transmitted signals and terrestrial re-transmissions of received satellite transmitted signals.

16. The combined satellite and terrestrial antenna for a vehicle according to claim 9, wherein the multi-band terrestrial antenna comprises:

a conventional AM/FM antenna configured to receive terrestrial retransmission of received satellite signals.

17. The combined satellite and terrestrial antenna for a vehicle according to claim 9, wherein the multi-band terrestrial antenna comprises:

a terrestrial SDARS antenna, configured to receive conventional AM/FM signals and terrestrial retransmission of received satellite signals.

18. The combined satellite and terrestrial antenna for a structure according to claim 9, wherein:

the satellite antenna is mounted at any position on the multi-band terrestrial antenna.

19. A method for mounting a combined satellite and terrestrial antenna system on a structure comprising the following steps:

mounting a multi-band terrestrial antenna on a mounting assembly;

mounting the satellite antenna having a different frequency band from that of the multi-band terrestrial antenna concentrically with the multi-band terrestrial antenna;

mounting the mounting assembly in a mounting hole on a structure, the mounting assembly comprising a low noise amplifier circuit and a bezel, the bezel containing the low noise amplifier;

locating satellite receiver hardware in proximity to the combined satellite and terrestrial antenna system; and connecting the satellite antenna, the multi-band terrestrial antenna, the satellite receiver hardware and terrestrial receiver hardware with appropriate cables.

20. The method for mounting a combined satellite and terrestrial antenna system on a structure according to claim 19, wherein the step of mounting the multi-band terrestrial antenna in a mounting hole and mounting the satellite antenna concentrically with the multi-band terrestrial antenna comprises:

mounting both the multi-band terrestrial antenna and satellite antenna of a different frequency band mounted at a common location on the structure, such that the angle formed by the difference in height between the top of an obstruction and the height of the satellite antenna, and the distance from the obstruction and the combined concentrically mounted satellite and multi-band terrestrial antenna is less than 20 degrees.

21. The method for mounting a combined satellite and terrestrial antenna system on a structure according to claim 20, wherein the obstruction comprises:

a roof of the automobile.

22. The method for mounting a combined satellite and terrestrial antenna system on a structure according to claim 19, wherein the structure is selected from the group consisting of an automobile, a recreational vehicle, a house, a building, a train and an aircraft.

23. A combined satellite and terrestrial antenna system for a structure, comprising:

a terrestrial antenna mounted on a mounting assembly;

a satellite antenna concentrically mounted with respect to the terrestrial antenna;

the mounting assembly comprising a low noise amplifier circuit and a bezel, the bezel containing the low noise amplifier;

a satellite receiver;

an AM/FM receiver connected to the satellite receiver by a first cable; and the mounting assembly connected to the satellite receiver by a third cable and a fourth cable and connected to the AM/FM receiver by a fifth cable.

24. The combined satellite and terrestrial antenna system for a structure according to claim 23, wherein the AM/FM receiver comprises:

a head unit; and an AM/FM tuner.

25. A combined satellite and terrestrial antenna system for a structure, comprising:

a terrestrial antenna mounting assembly;

a satellite antenna concentrically mounted with respect to the terrestrial antenna; and the mounting assembly comprising a low noise amplifier circuit and a bezel, the bezel containing the low noise amplifier, wherein the low noise amplifier circuit comprises a satellite low noise amplifier with a first input connected to a first end of a second cable and a second end of the second cable connected to the satellite antenna;

a combiner with a first input connected to a first end of a sixth cable and a second end of the sixth cable connected to the terrestrial antenna;

a fourth cable connected to the output of the satellite low noise amplifier;

a third cable connected to a first output of the combiner; and a fifth cable connected to a second output of the combiner.

26. The combined satellite and terrestrial antenna system for a structure according to claim 25, wherein the combiner comprises:

a terrestrial low noise amplifier with an input and an output;

a circuit with an input and an output;

the input of the circuit connected to the input of the terrestrial low noise amplifier and connected to a first end of a sixth cable; and the output of the combiner comprising the output of the terrestrial low noise amplifier and the output of the circuit.

27. The combined satellite and terrestrial antenna system for a structure according to claim 26, wherein the circuit comprises:

a passive circuit element.

28. The combined satellite and terrestrial antenna system for a structure according to claim 27, wherein the passive circuit element comprises:

an inductor, tuned to operate as an open circuit as satellite transmission frequencies and as a short circuit at conventional terrestrial AM/FM transmission frequencies.

29. The combined satellite and terrestrial antenna system for a structure according to claim 26, wherein the circuit comprises:

an arrangement of passive devices configured and tuned to operate as an open circuit as satellite transmission frequencies and as a short circuit at conventional terrestrial AM/FM transmission frequencies.

30. The combined satellite and terrestrial antenna system for a structure according to claim 26, wherein the circuit comprises:

an arrangement of passive and active devices configured and tuned to operate as an open circuit as satellite transmission frequencies and as a short circuit at conventional terrestrial AM/FM transmission frequencies.

31. The combined satellite and terrestrial antenna system for a structure according to claim 26, wherein the circuit comprises:

an arrangement of active devices configured and tuned to operate as an open circuit as satellite transmission frequencies and as a short circuit at conventional terrestrial AM/FM transmission frequencies.

32. The combined satellite and terrestrial antenna system for a structure according to claim 25, wherein the third and fifth cable are combined to form a seventh cable, the seventh cable connected to the first and second output of the combiner.

33. A combined satellite and terrestrial antenna system for a structure, comprising:

a terrestrial antenna mounted on a mounting assembly;

a satellite antenna concentrically mounted with respect to the terrestrial antenna;

the mounting assembly comprising a low noise amplifier circuit and a bezel, the bezel containing the low noise amplifier;

a satellite receiver;

an AM/FM receiver connected to the satellite receiver by a first cable;

the mounting assembly connected to the satellite receiver by a third cable and connected to a splitter by a sixth cable; and the splitter connected to the satellite receiver by a seventh cable and to the AM/FM receiver by an eighth cable.

34. The combined satellite and terrestrial antenna system for a structure according to claim 33, wherein the AM/FM receiver comprises:

an AM/FM tuner connected to the splitter by the eighth cable; and a head unit connected the AM/FM tuner by a ninth cable and to the satellite receiver by the first cable.

35. A combined satellite and terrestrial antenna system for a vehicle comprising:

a terrestrial antenna mounted on a mounting assembly;

a satellite antenna concentrically mounted with respect to the terrestrial antenna;

the mounting assembly comprising a low noise amplifier circuit and a bezel, the bezel containing the low noise amplifier, and wherein the mounting assembly is mounted on the vehicle;

a satellite receiver;

an AM/FM receiver connected to the satellite receiver by a third cable and a fourth cable and connected to the AM/FM receiver by a fifth cable.

36. The combined satellite and terrestrial antenna system for a vehicle according to claim 35, wherein the AM/FM receiver comprises:

a head unit; and an AM/FM tuner.

37. A combined satellite and terrestrial antenna system for a structure, comprising:

a terrestrial antenna mounted on a mounting assembly;

a satellite antenna concentrically mounted with respect to the terrestrial antenna, on the uppermost portion of the terrestrial antenna; and the mounting assembly comprising a low noise amplifier circuit and a bezel, the bezel containing the low noise amplifier.

38. The combined satellite and terrestrial antenna for a structure according to claim 37, wherein:

the terrestrial antenna is a retractable terrestrial antenna.

39. The combined satellite and terrestrial antenna for a structure according to claim 38, wherein:

the combined satellite and terrestrial antenna retract to a location within the structure.

40. The combined satellite and terrestrial antenna for a structure according to claim 38, wherein:

the combined satellite and terrestrial antenna retract to a location on the surface of the structure.

41. A combined satellite and terrestrial antenna system for a vehicle comprising:

a terrestrial antenna mounted on a mounting assembly;

a satellite antenna concentrically mounted with respect to the terrestrial antenna, on the uppermost portion of the terrestrial antenna; and the mounting assembly comprising a low noise amplifier circuit and a bezel, the bezel containing the low noise amplifier, and wherein the mounting assembly is mounted on the vehicle.

42. The combined satellite and terrestrial antenna for a structure according to claim 41, wherein:

the terrestrial antenna is a retractable terrestrial antenna.

43. The combined satellite and terrestrial antenna for a structure according to claim 42, wherein:

the combined satellite and terrestrial antenna retract to a location within the structure.

44. The combined satellite and terrestrial antenna for a structure according to claim 42, wherein:

the combined satellite and terrestrial antenna retract to a location on the surface of the structure.

* * * * *